US005544390A

United States Patent [19]

Hartung et al.

[11] Patent Number: 5,544,390

[45] Date of Patent: Aug. 13, 1996

[54] REGULATING DRAWING UNIT FOR A SLIVER DRAWING FRAME AND REGULATING METHOD

[75] Inventors: Reinhard Hartung; Fritz Hösel, both of Mönchengladbach, Germany

[73] Assignee: Trützschler GmbH & Co. KG, Mönchengladbach, Germany

[21] Appl. No.: 358,586

[22] Filed: Dec. 13, 1994

[30] Foreign Application Priority Data

Dec. 20, 1993 [DE] Germany ..... 43 43 499.1
Nov. 18, 1994 [DE] Germany ..... 44 41 067.0

[51] Int. Cl.[6] ..... D01H 5/38

[52] U.S. Cl. ..... 19/240; 19/150; 19/239

[58] Field of Search ..... 19/65 A, 239, 19/240, 106 R, 150, 157

[56] References Cited

U.S. PATENT DOCUMENTS

| | | | |
|---|---|---|---|
| 2,681,475 | 6/1954 | Raper | 19/70 |
| 4,302,968 | 12/1981 | Moser | 19/239 X |
| 5,018,246 | 5/1991 | Leifeld | 19/150 |
| 5,052,080 | 10/1991 | Gründler | 19/239 X |
| 5,134,755 | 8/1992 | Jornot et al. | 19/239 |
| 5,248,925 | 9/1993 | Jornot | 19/239 X |
| 5,412,301 | 5/1995 | Jornot et al. | 19/240 X |

FOREIGN PATENT DOCUMENTS

| | | |
|---|---|---|
| 0477589 | 4/1992 | European Pat. Off. . |
| 36 35 341 | 4/1988 | Germany . |

*Primary Examiner*—John J. Calvert
*Attorney, Agent, or Firm*—Spencer & Frank

[57] ABSTRACT

A drawing frame includes an inlet measuring organ sensing a property of a plurality of slivers as they are simultaneously introduced into the drawing frame and emitting a measuring signal representing a magnitude of the property; a regulating drawing unit including a plurality of drawing rolls defining a drawing region along which the slivers are drafted as they run through the drawing frame, a drive for rotating the drawing rolls and a control arrangement for regulating the drive as a function of the measuring signal for varying the draft of the slivers in the drawing region such that mass fluctuations in the slivers are equalized. The control arrangement changes the measuring signal into an actual control signal as a function of operational conditions to compensate for influences derived from the operational conditions and affecting measuring results. The control signal is applied to the drive.

16 Claims, 3 Drawing Sheets

REGULATING DRAWING UNIT FOR A SLIVER DRAWING FRAME AND REGULATING METHOD

CROSS REFERENCE TO RELATED APPLICATION

This application claims the priority of German Application Nos. P 43 43 499.1 filed Dec. 20, 1993 and P 44 41 067.0, filed Nov. 18, 1994, which are incorporated herein by reference.

BACKGROUND OF THE INVENTION

This invention relates to a regulating drawing unit forming part of a sliver drawing frame. The unit includes an inlet measuring organ for a plurality of slivers entering the unit, at least one drawing field, a drive system and a control (regulation) for the drive system. The control responds to a measuring signal emitted by the inlet measuring organ in order to alter the draft by the drive system in the drawing field in such a manner that fluctuations in the input sliver mass are corrected.

Published European Patent Application 477 589 discloses a regulating drawing unit in two embodiments for regulating the slivers. According to the first embodiment, two measuring organs are provided for the throughgoing fiber material: one measuring organ is situated at the inlet and the other is disposed at the outlet of the drawing unit. At the inlet of the drawing unit the entire cross section of the inputted slivers is measured by a measuring condenser constituting the inlet measuring organ. The fluctuating fiber mass of the slivers which runs between the condenser plates with a speed of approximately 150 m/min acts as the dielectric of the condenser. Due to the difficulties experienced at the inlet side measuring, the regulation is so designed that the measuring errors are compensated for by means of an adaptive regulation. For this purpose at the outlet of the drawing unit a further measuring organ (outlet measuring organ) is provided. Problems and errors involved in measurement techniques are considered in the known regulating system by virtue of the fact that the measuring signals of the outlet measuring organ are taken into account to adapt the regulation to the inlet-side measuring errors. It is therefore a necessary requirement that a measuring organ be disposed before and after the regulating path, that is, in a principal drawing region. Such an arrangement is structurally complex. Further, the running time of the fiber material between the measuring locations at the inlet and at the outlet have to be taken into consideration. It is a further disadvantage that the running speed of the individual slivers through the outlet measuring organ are approximately six times higher than the running speed of the slivers through the inlet measuring organ. Taking into account these effects at high speeds and short reaction times requires a very complex regulating system.

According to the second embodiment disclosed in the European application 477 589 only an outlet measuring organ is provided whose structure is different from the inlet measuring organ of the first embodiment and responds directly to the fiber mass (that is, to the cross section of the sliver). The outgoing sliver is compressed with a sensor roll pair formed of a grooved roller and a tongue roller and thereafter the thickness of the compressed fiber material is evaluated as a measure for the outgoing fiber mass. The disadvantage of such a measuring procedure resides in that the compression (densification) of the fiber material is, among others, dependent from its throughgoing speed, that is, the measuring signal is speed-dependent. Such a speed dependency means that the same sliver quantity (for example, a length of 15 m) yields different thickness measurements for different sliver speeds. Such a disadvantage is experienced during the acceleration and deceleration of the machine, that is, during velocity variations. In high-performance drawing frames of current design (which operate with sliver speeds of 1,000 m/min and above) a coiler can is, at the outlet of the drawing frame, filled in about 5 to 7 minutes, and for replacing the coiler can, the operating speed is reduced to a very low speed or even to a standstill. During the accelerating and decelerating steps the measured density values of approximately 10 to 15 m length of sliver introduced into the coiler can have been affected in an undesired manner because of the speed dependency. Such occurrence also adversely affects the equalization of the mass fluctuations of the slivers in the drawing unit. It is a disadvantage, among others, that the measurement is effected during the high delivery speed of the individual outgoing slivers which is approximately six times higher than the speed of the slivers introduced into the drawing unit. It is an even more serious drawback that with the outlet measuring organ no automatic optimization by subsequent verification of the results is possible because the outlet measuring organ constitutes the last monitoring point for the obtained results.

SUMMARY OF THE INVENTION

It is an object of the invention to provide a regulating drawing unit of the above-outlined type from which the discussed disadvantages are eliminated and which, in particular, is structurally simple and makes possible an improved equalization of the slivers, particularly during speed alteration, for example, during braking and acceleration.

This object and others to become apparent as the specification progresses, are accomplished by the invention, according to which, briefly stated, the drawing frame includes an inlet measuring organ sensing a property of a plurality of slivers as they are simultaneously introduced into the drawing frame and emitting a measuring signal representing a magnitude of the property; a regulating drawing unit including a plurality of drawing rolls defining a drawing region along which the slivers are drafted as they run through the drawing frame, a drive for rotating the drawing rolls and a control arrangement for regulating the drive as a function of the measuring signal for varying the draft of the slivers in the drawing region such that mass fluctuations in the slivers are equalized. The control arrangement changes the measuring signal into an actual control signal as a function of operational conditions to compensate for influences derived from the operational conditions and affecting measuring results. The control signal is applied to the drive.

Thus, according to the invention, the inlet measuring signal representing the sliver mass is directly compensated by equalizing particularly the speed-dependent errors. By virtue of the fact that, in contrast to known regulating drawing units, the use of an outlet measuring organ for the regulation is avoided, a significant structural simplification is achieved. In addition, the technological complexities as concerns the compensation for the travelling period between the inlet and outlet measuring organs are no longer present. A secure compensation (correction) is effected already at the inlet zone which is the sole measuring location for the regulation. The compensation is effected solely at the substantially lower inlet speeds of the plurality of slivers rather than at the high outlet speed for the single outgoing sliver. The problem that the outlet measuring organ, as in conventional arrangements, is participating in the regulation and thus cannot participate as a monitoring organ for the regulating process (subsequent verification of results) is eliminated from the system according to the invention. As a result, the regulating drawing unit according to the invention makes possible a very simple regulating process which may be monitored more easily and is more economical than prior art arrangements.

The invention has the following additional advantageous features:

- The measuring signal of the intake measuring organ is adjusted as a function of the extent of draw exerted on that sliver portion which gave rise to the measuring signal.
- The measuring signal of the inlet measuring organ is corrected as a function of the sliver speed.
- The inlet measuring organ is adapted to determine the cross section of the throughgoing sliver.
- The control and regulating device is connected with a memory in which empirically determined functions (dependencies) between actual values of the incoming fiber mass and the running speed of the sliver are stored. These functions are stored as regulating algorithms or in table form.
- The functions are stored for unlike fiber types.
- The control and regulating device (computer) calculates a corrected measuring signal from the distorted inlet measuring signal for the sliver mass, and emits the corrected measuring signal as an actual value for the sliver mass.
- The computation of the signal for the actual value is effected according to this relationship: actual value of the sliver mass=measuring signal of the sliver mass less a times the sliver speed where is a correcting factor.
- A sliver speed sensor is connected with the control and regulating device.

DESCRIPTION OF THE PREFERRED EMBODIMENTS

Figure 1:
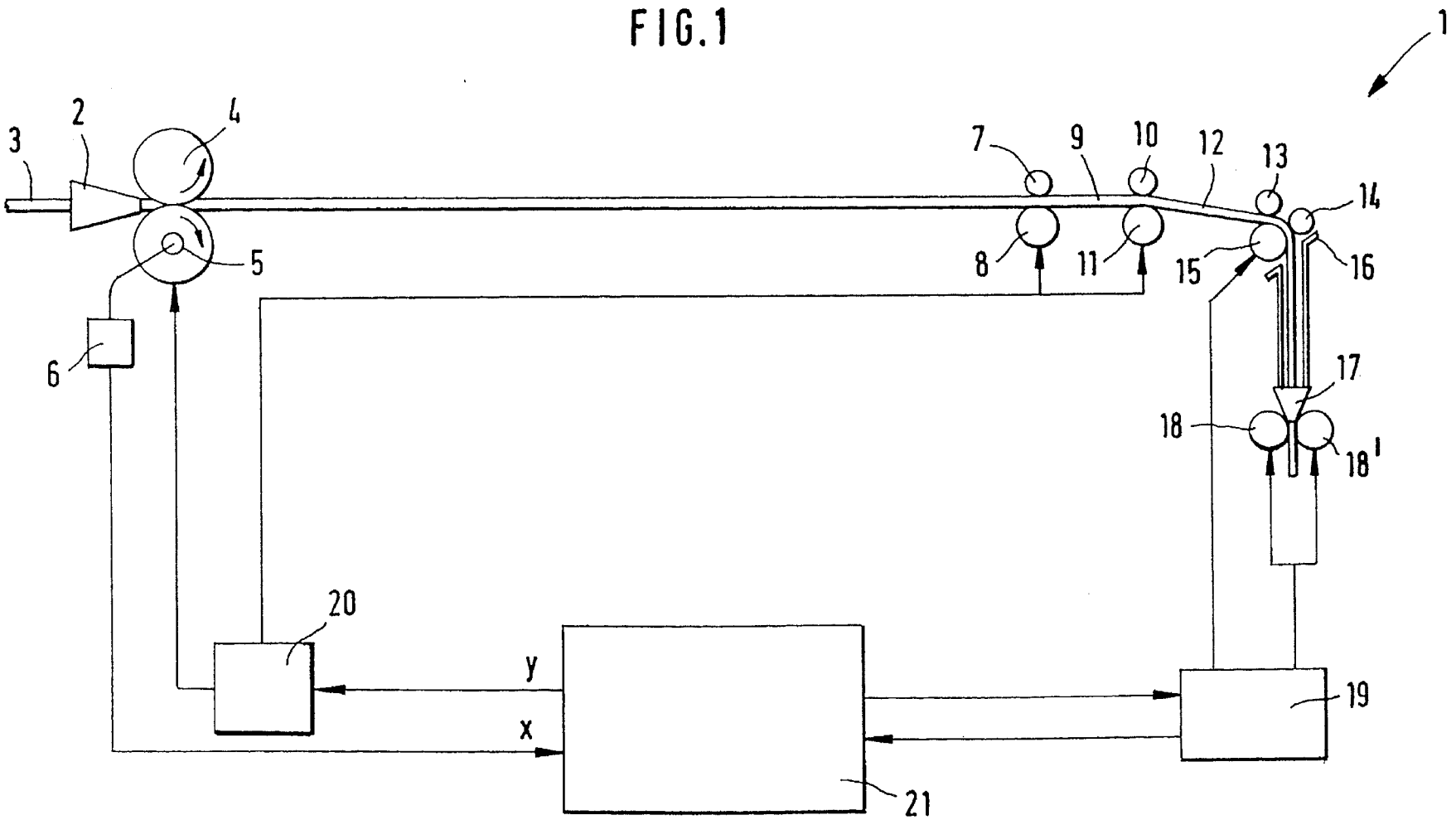
FIG. 1 is a schematic view, with block diagram, of a regulating drawing unit according to the invention, forming part of a drawing frame.

FIG. 1 illustrates a high-performance regulating drawing frame which may be, for example, an HS 900 Model, manufactured by Trützschler GmbH & Co. KG, M önchengladbach, Germany. A plurality of slivers 3, taken from non-illustrated coiler cans, enter into a forwardly tapering sliver guide 2 and are drawn and further advanced by cooperating pull-off rolls 4, 5. In response to the sliver thickness fluctuations as the slivers run through the nip of the pull-off rolls 4 and 5, the radially displaceably suspended roll 5 executes excursions which are converted to a representative electric signal by an inductive displacement sensor 6. The latter has an armature which follows the movements of the radial excursions of the roll 5 and a solenoid cooperating with the armature. The drawing unit 1 of the drawing frame is essentially formed of upper and lower inlet rolls 7 and 8, respectively, which, together with the respective upper and lower pre-drawing rolls 10 and 11 form the pre-drawing region 9. Between the pre-drawing upper roll 10 cooperating with the pre-drawing lower roll 11 and the main upper drawing roll 13 and the main lower drawing roll 15 the main drawing region 12 is situated. A second main upper drawing roll 14 is associated with the main lower drawing roll 15. This arrangement is thus designated as a four over three drawing system.

The drawn (stretched) slivers 3, after running past the main upper drawing roll 14, reach the sliver guide 16 and are, by means of delivery rolls 18, 18' pulled through a sliver trumpet 17 in which they are gathered into a single sliver and deposited in coiler cans not shown. The main drawing rolls 13, 14, 15 and the delivery rolls 18, 18' are driven by a main motor 19 which is controlled by a computer (control and regulating device) 21. To the computer 21 there are applied the signals emitted by the measuring member 6 and converted into commands for the control of a regulating motor 20 which drives the upper pull-off roll 4, the lower pull-off roll 5 as well as the rolls of the pre-drawing region 9, that is, the upper inlet roll 7, the upper inlet roll 8, the upper pre-drawing roll 10 and the lower pre-drawing roll 11. Dependent upon the values of the entering slivers 3, determined by the measuring member 6, the fluctuations are controlled via the computer 21 by means of the regulating motor 20 by altering the rpm of the rolls 4, 5, 7, 8, 10 and 11.

The pull-off rolls 4 and 5 are groove-and-tongue rolls between which the fiber material is compressed. As noted earlier, the radial excursions of the radially resiliently displaceable roll 5 are converted by the inductive path sensor 6 into electric signals which, in turn, applied to the computer 21.

Figure 2:
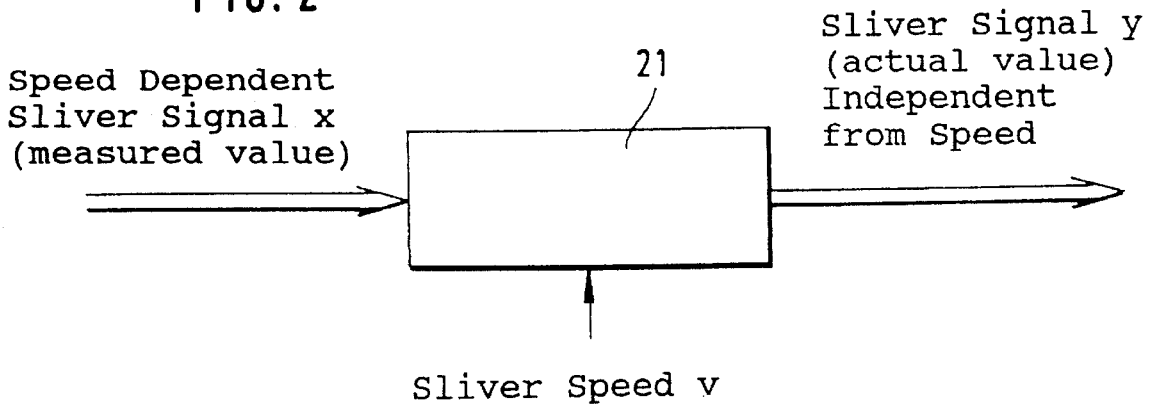
FIG. 2 is a diagram illustrating a linkage and correction of the speed-dependent measuring signal x representing the fiber mass of the throughgoing sliver.

FIG. 2 schematically illustrates the compensation of the speed-dependent component of a sliver mass measurement as used at the inlet side of the drawing frame 1 for the control of the draft.

Prior to entering the drawing unit 1, the sliver material to be stretched is compressed and then the thickness of the compressed fiber material is evaluated as a measure for the entering fiber mass. Since the compression (densification) of the material is, among others, dependent from the throughgoing speed, according to the invention the apparatus 21 is provided which compensates for the speed-dependency of the measuring signal. For this purpose, in addition to the measuring signal, a signal representing the speed of the running sliver is applied to the apparatus 21. The speed signal is generated by a sliver speed sensor, such as a tachogenerator 29. The apparatus 21 forms a speed-independent signal from the measuring signal and the speed signal. The apparatus 21 according to the invention makes possible a control of the draft of the drawing unit 1 independently from the sliver speed. This provides an important precondition to control the draft in such a manner even during accelerations and decelerations of the drawing unit 1 that the obtained fiber mass is maintained at a constant value.

Figure 3:
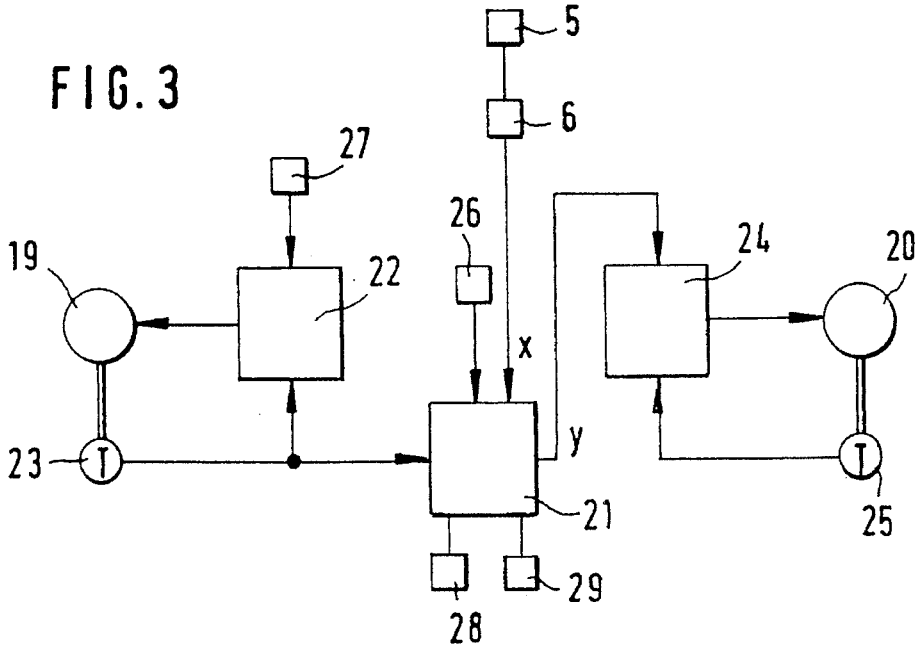
FIG. 3 is a block diagram of the control of the regulating drawing unit according to the invention.

Turning to FIG. 3, a motor regulator 22 and a tachogenerator 23 are associated with the main motor 19. Further, a motor regulator 24 (rpm regulation) and a tachometer 25 are associated with the regulating motor 20. The signal output of the sensor roll 5 and a desired value transmitter 26 for the delivery speed are connected to the control and regulating apparatus 21 (computer with microprocessor). A desired value inputter 27 for the rpm of the motor 19 is associated with the regulator 22. The computer 21 determines the desired value for the regulator 24.

In the description which follows, the operation of the above-discussed arrangement will be set forth.

The intake measuring signal whose measured value x has been distorted (falsified) by various interfering effects (for example, the running speed of the sliver) is applied, together with other signals representing the momentary operating conditions, to the microcomputer 21 where it is recalculated as a function of the momentary sliver speed and other influences in such a manner that the negative effects are eliminated to the greatest extent. Then, such a "purified" signal, representing the actual value y is used to calculate the required rpm's for the rolls of the drawing unit to obtain the desired sliver mass. This process is performed several hundred times per second.

For recomputing to eliminate the error effects the following steps are performed:

1. The influences of, for example, the sliver running speed and similar parameters affecting the sliver are experimentally determined (deviations).
2. The determined deviations are each stored, as an algorithm or as a table, for example, in a memory 28 of the computer 21.

EXAMPLE (a) Algorithm.

Figure 4:
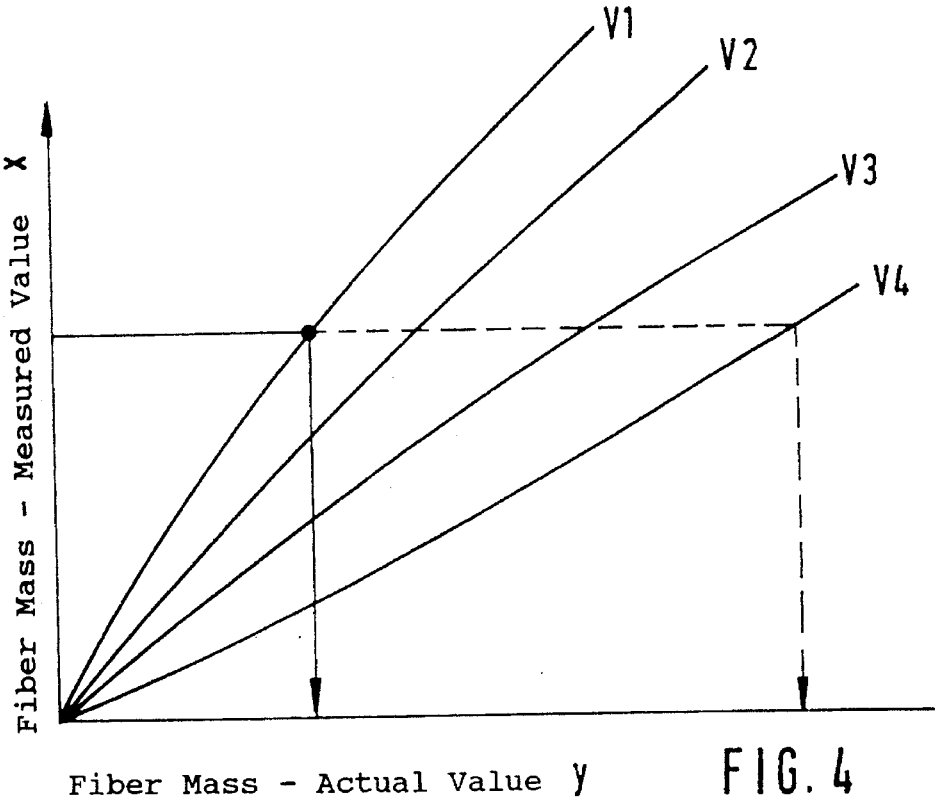
FIG. 4 is a diagram illustrating the function between the actual and desired sliver mass values for several sliver speeds.

In FIG. 4 there is shown the function between the measured value x of the sliver mass and the actual value y of the sliver mass for the various speeds $V_1$ to $V_4$ (in m/min). The units for x and y are given as the metric sliver number $N_m$ in m/g or its reciprocal value $$\frac{1}{N_m}$$

(in g/m).

Measured value x=actual value y+a times the sliver delivery speed v.

The measured, error-laden (distorted) value x (measuring value) is always by an amount a times delivery speed greater than the actual value. It follows that an error elimination by a computation actual value y=measured value x minus a times the sliver delivery speed v is possible. The factor a corresponds, for example, to the deviation determined in the tests as noted in point 1. above.

(b) Table.

This method finds application if the function between measured value and the actual value cannot be unequivocally defined by an algorithm.

| Delivery Speed v m/min | Actual Value y |
|---|---|
| 0–50 | Measured value −3.17 |
| 51–55 | Measured value −2.95 |
| 56–80 | Measured value −3.00 |

-continued

| Delivery Speed v m/min | Actual Value y |
|---|---|
| 81–250 | Measured value −3.20 |
| 250–500 | Measured value +0.53 |
| 501–800 | Measured value +0.91 |
| 801–900 | Measured value +1.14 |

It is to be understood that as a general rule, a combination of the above-discussed two methods (a) and (b) is feasible.

As a result, a significant advantage of the invention resides in that no outlet measuring organ is needed and, nevertheless, for example, a speed-dependent error may be compensated for.

Thus, the particular advantages of the invention are as follows:

(1) No "outlet measuring organ" is needed.

(2) The intake measuring signal x is directly compensated for by equalizing the speed-dependent errors.

(3) The entire process is significantly simpler and thus more easily monitorable and more economical than prior art arrangements.

Figure 5:
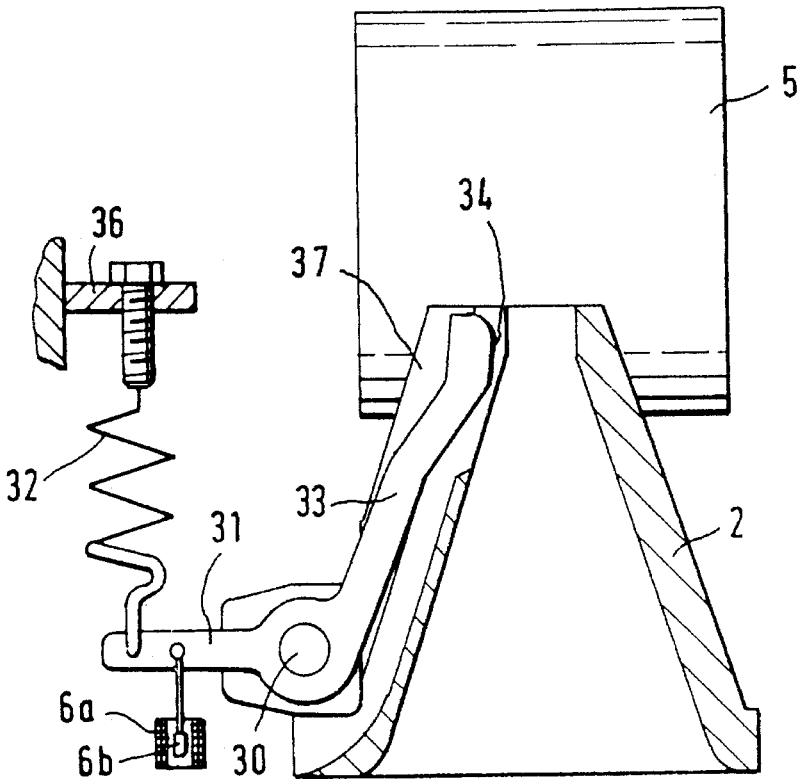
FIG. 5 is a schematic sectional view of an inlet sliver sensor used in the system according to the invention.

The intake measuring organ may be constructed as shown in FIG. 5 (also disclosed in German Offenlegungsschrift 44 04 326). In this construction a sensor element 33 having a sensor surface 34 for the slivers 3 is situated in a recess 37 of the sliver guide 2 and is maintained in its position by a rotary bearing 30. The sensor element 33 has a lever 31 which is biased by a spring 32 held in a spring support 36. The lever 31 cooperates with the measuring element 6 which is formed as an inductive plunger type instrument having a plunger coil *6a* and an armature *6b*.

It will be understood that the above description of the present invention is susceptible to various modifications, changes and adaptations, and the same are intended to be comprehended within the meaning and range of equivalents of the appended claims.

What is claimed is:

1. In a drawing frame including an inlet measuring organ sensing a property of a plurality of slivers as they are simultaneously introduced into the drawing frame and emitting a first or measuring signal representing a magnitude of said property;

a regulating drawing unit including a plurality of drawing rolls defining a drawing region along which the slivers are drafted as they run through the drawing frame;

a drive for rotating the drawing rolls; and control means for regulating said drive as a function of said measuring signal for varying the draft of said slivers in said drawing region such that mass fluctuations in the slivers are equalized;

the improvement wherein said control means comprises (a) means for generating a second signal representing an operational parameter influencing said first signal;

(b) recalculating means for changing said first signal into a third or actual control signal as a function of said second signal to compensate for influences derived from said operational parameter and affecting measuring results; and (c) means for applying said third signal to said drive.

2. A drawing frame as defined in claim 1, further including means for changing the measuring signal into said control signal as a function of a drafting magnitude applied to a sliver length to which said measuring signal relates.

3. A drawing frame as defined in claim 1, wherein said inlet measuring organ includes means for sensing a total thickness of the slivers running through said inlet measuring organ.

4. A drawing frame as defined in claim 1, further comprising a memory connected to said control means.

5. A drawing frame as defined in claim 1, wherein said control means includes a computer.

6. A drawing frame as defined in claim 1, further comprising a sliver inlet guide tapering in a direction of sliver run for gathering the simultaneously running slivers at a frame inlet; said inlet measuring organ being incorporated into said sliver inlet guide and including a sensor element movably supported by said sliver inlet guide; said sensor element having an end arranged for engaging the sliver in said sliver inlet guide; said inlet measuring organ further including means for biasing said sensor element against the sliver and a plunger coil unit connected to said sensor element for converting displacements of said sensor element into electric signals representing the displacements.

7. The drawing frame as defined in claim 1, wherein said operational parameter is a running speed of the slivers; said means for generating said second signal comprises a sliver speed sensor.

8. A method of regulating a drawing unit of a drawing frame; the drawing frame including an inlet measuring organ sensing a property for a plurality of slivers as they are simultaneously introduced into the drawing frame and emitting a first or a measuring signal representing a measured value of said property; the drawing unit including a plurality of drawing rolls defining a drawing region along which the slivers are stretched as they run through the drawing frame;

a drive for rotating the drawing rolls; and control means for regulating said drive as a function of said first signal for varying the draft of said slivers in said drawing region such that mass fluctuations in the slivers are equalized;

the method comprising the steps of (a) generating a second signal representing an operational parameter influencing said first signal;

(b) changing the first signal into a third or actual control signal, representing an actual value, as a function of said second signal to compensate for influences derived from said operational parameter and affecting measuring results.

9. The method as defined in claim 8, further comprising the step of applying said actual control signal to said drive during braking of the drawing rolls.

10. The method as defined in claim 8, further comprising the step of applying said actual control signal to said drive during acceleration of the drawing rolls.

11. The method as defined in claim 8, wherein the operational parameter is a running speed of the slivers.

12. A method of regulating a drawing unit of a drawing frame; the drawing frame including an inlet measuring organ sensing a property for a plurality of slivers as they are simultaneously introduced into the drawing frame and emitting a measuring signal representing a measured value of said property; the drawing unit including a plurality of drawing rolls defining a drawing region along which the slivers are stretched as they run through the drawing frame;

a drive for rotating the drawing rolls; and control means for regulating said drive as a function of said measuring signal for varying the draft of said slivers in said drawing region such that mass fluctuations in the slivers are equalized;

the method comprising the steps of (a) changing the measuring signal into an actual control signal, representing an actual value, as a function of operational conditions to compensate for influences derived from said operational conditions and affecting measuring results;

(b) empirically determining relationships between said actual value and a running speed of the slivers; and (c) storing the relationships in a memory connected to said control means.

13. The method as defined in claim 12, wherein said relationships are stored as an algorithm.

14. The method as defined in claim 12, wherein said relationships are stored in table form.

15. The method as defined in claim 12, further comprising the step of storing said relationships for different sliver types.

16. A method of regulating a drawing unit of a drawing frame; the drawing frame including an inlet measuring organ sensing a property for a plurality of slivers as they are simultaneously introduced into the drawing frame and emitting a measuring signal representing a measured value of said property; the drawing unit including a plurality of drawing rolls defining a drawing region along which the slivers are stretched as they run through the drawing frame;

a drive for rotating the drawing rolls; and control means for regulating said drive as a function of said measuring signal for varying the draft of said slivers in said drawing region such that mass fluctuations in the slivers are equalized;

the method comprising the steps of (a) changing the measuring signal into an actual control signal, representing an actual value, as a function of operational conditions to compensate for influences derived from said operational conditions and affecting measuring results; and (b) determining the actual value by subtracting from the measured value a running speed of the sliver multiplied by a correcting factor.

* * * * *